United States Patent [19]

Peters et al.

[11] 3,971,273

[45] July 27, 1976

[54] MEAT SLICING BOARD

[75] Inventors: Leo Peters, Grand Rapids, Mich.; Joseph M. Dymit, Addison, Ill.; James C. Lilley, Ada, Mich.; Donald R. Smith; Henry Warners, both of Grand Rapids, Mich.

[73] Assignee: Leo Peters, Grand Rapids, Mich.

[22] Filed: Feb. 26, 1975

[21] Appl. No.: 553,247

[52] U.S. Cl. ..... 83/42; 83/157; 83/762; 83/455; 83/467 R

[51] Int. Cl.[2] ..... B26D 4/42; B26D 4/46

[58] Field of Search ..... 83/761, 762, 455, 466.1, 83/467, 109, 157, 42; 269/13, 14, 15, 303, 313

[56] References Cited

UNITED STATES PATENTS

| | | | |
|---|---|---|---|
| 942,613 | 12/1909 | Chow | 269/15 |
| 1,202,158 | 10/1916 | Caldwell | 83/762 X |
| 1,658,743 | 2/1928 | Sayer | 83/762 |
| 2,311,618 | 2/1943 | Coleman | 83/157 |
| 2,322,433 | 6/1943 | Gammache | 83/762 |
| 2,855,965 | 10/1958 | Vidovic | 83/157 |

*Primary Examiner*—Willie G. Abercrombie

[57] ABSTRACT

A method and means for portion-control, hand-slicing of boneless meat roasts without using hands or eyes to control the thicknesses of the slices.

11 Claims, 10 Drawing Figures

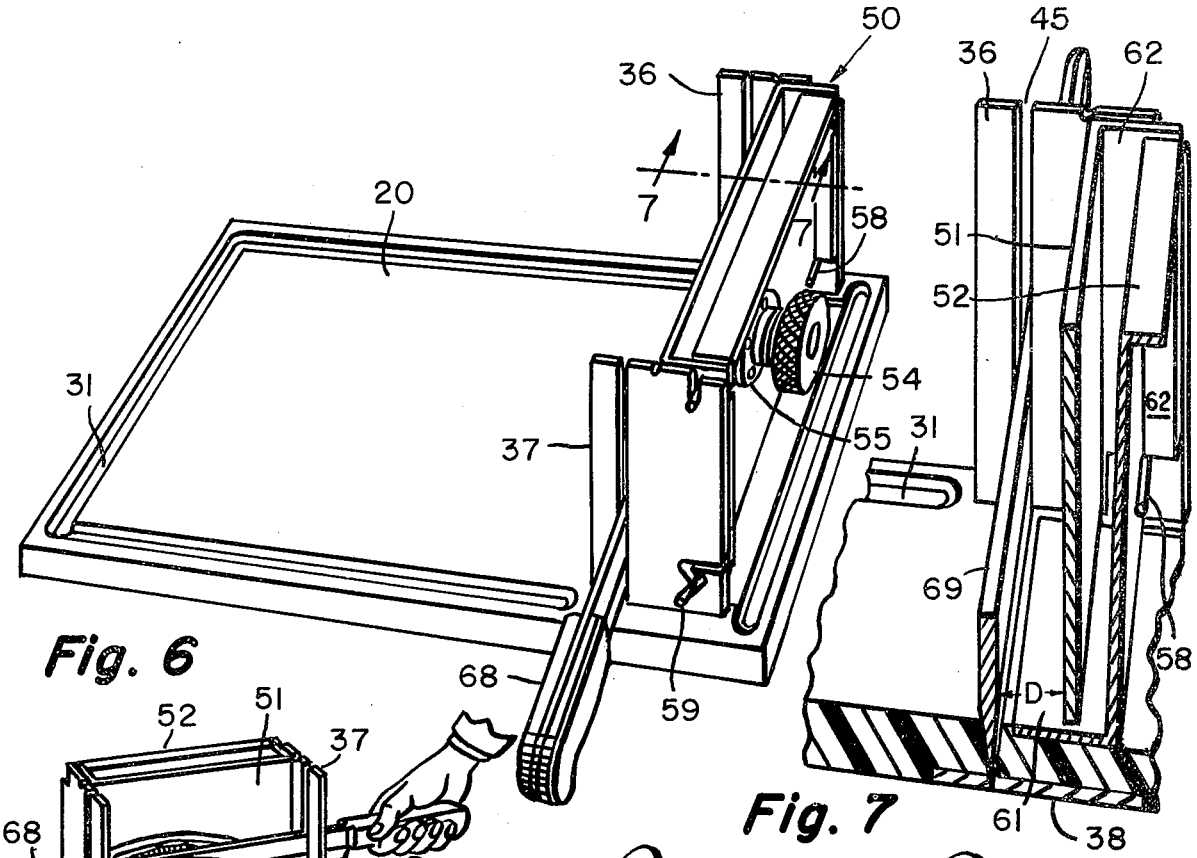
Fig. 6
Fig. 7
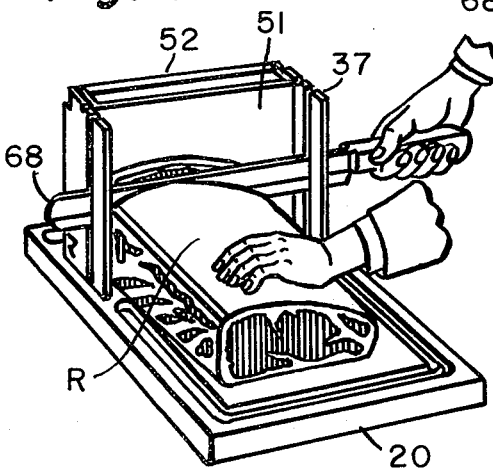
Fig. 8
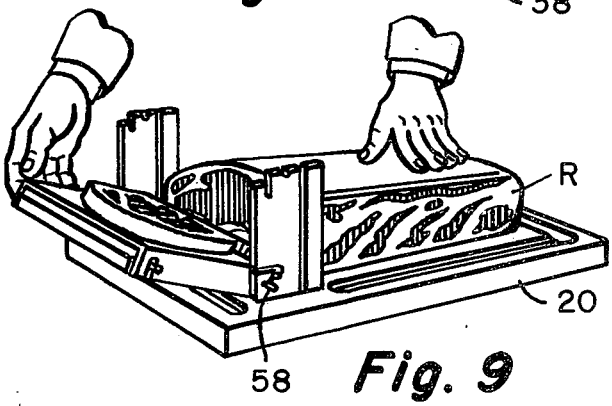
Fig. 9
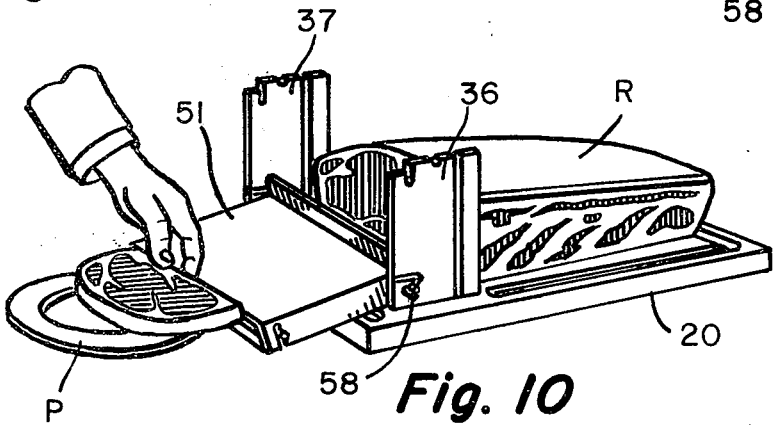
Fig. 10

MEAT SLICING BOARD

BACKGROUND OF THE INVENTION

The slicing of meat roasts for serving on dinner menus of restaurants presents serious cost-control, weight-control, and quality-control problems. Meat roasts have a wide and non-uniform range in weights: from about 8 lbs. to 32 lbs. The portions that must ultimately be served to individual diners have a much narrower range in weights: from about 4 oz. to 12 oz. The various animal carcasses from which the roasts are cut yield whatever sizes and conformations their natural marketing weights and shapes produce. The restaurateur must then take these imprecise and non-uniform natural sizes and shapes and slice them down into precise-sized slices and weights for serving to his customers. They must be tailored to a rather narrow and exact price and weight acceptable to the restaurateur's customers. He is thus confronted with purchasing meat that lacks precision in weight and shape, while being required to serve his customers with portions that must be quite precise in weight and shape.

Whether on a-la-carte (each item individually priced) or on composite-dinner priced menus, restaurants must know the cost of each individual item. Of the several items normally comprising an average full-course dinner (soup, salad, meat, potatoes, vegetable, beverage, dessert, bread and butter) the meat entree is usually the most expensive and, in the case of roasted meats, the most difficult for which to figure cost.

In addition to their odd and non-uniform shapes, the reason meat roasts are difficult to cost-control is that they can be portioned only after roasting. They must be roasted in their entirety and then sliced for individual servings afterward, while they are hot and flabby, and thus difficult to handle and control while slicing into them. By contrast, steaks are pre-cut and pre-portioned before broiling, while they are cold and firm-bodied, and thus easy to handle and portion-control while slicing into them.

When meat that has been roasted with its bones left in and then sliced, it is impossible to slice it into portions of equal weight and uniform thickness and size. The bones, and the spacing between the bones, effectively prevents portion-control slicing. As a result, many restaurants prefer to buy their roasts with the bones removed, then rolled, tied, and held together with strings. In the meat trade this is known as a boned, rolled, and tied roast. But, while this is an improvement for slicing-control purposes, it still leaves a non-uniform, oddly-shaped (for uniform slicing purposes) piece of meat. While it can be theoretically portion-controlled-sliced by hand, for all practical purposes it cannot.

Of the various boneless meat roasts from beef, veal, lamb, and pork, one of the most difficult and most expensive to portion-control and slice is boneless beef ribs. Because of this, we will use boneless beef ribs as the exemplary item of this invention, with the understanding that the problems and their solutions also apply to the other boneless meat roasts.

Several interrelated factors and their ensuing problems combine to make portion-controlled slicing of boneless ribs of beef extremely difficult. It is a practical impossibility to achieve and maintain close portion-control over the size, weight, thickenss, and therefore the cost of each sliced portion with the manual methods of the prior art. These factors, and the problems they create are as follows:

1. The problem of extremely odd and non-uniform shapes

Boneless beef ribs have a tapered shape; wide at one end and narrow at the other end; curved on one long side and relatively flat on the opposite long side; relatively thin on one long side, and relatively thick on the opposite long side. Furthermore, this odd shape will change somewhat from rib to rib. The ribs will range from shapes that are relatively long and narrow to those that are relatively short and bulky. All of these differences increase the difficulties in producing uniform portion-controlled slices for individual servings.

The prior art has devised various methods for altering the irregular natural shape of boneless beef ribs into shapes that are more suitable for uniform portion-controlled slicing. The most frequently-used methods are: (a) boning, rolling, and string-tying, and (b) compressing the meat into an enclosing stockinette or plastic tube. However, such methods produce certain deleterious results: (a) the compressed and/or roll-distorted meat has its juice cells squeezed and broken by these methods and the result is an excessive loss of juice during roasting; (b) then before or after slicing, when strings, stockinette, or plastic tube must be removed before serving, the once-confined meat has a tendency to fall apart and release the otherwise confined juice. In any event, the results from these methods are so deleterious to the valuable ribs of beef entrees that they are seldom used by restaurants for such entrees.

It is an object of this invention, therefore, to provide a method and means for better portion-controlled slicing of boneless ribs of beef that will retain the natural shape of the ribs while making it easier to compensate for the natural irregularities of shape.

2. The problem of hot meat

Meat entrees on dinner menus are normally served hot. For purposes of slicing, this means that the meat is flabby and its surfaces hot, oily and slippery. The heat and slippery surface makes it difficult to handle, hold, and maintain in a firm position for positive, even slicing. The flabbiness produces a movement within the meat itself that renders it very difficult to slice down thru the meat evenly.

It is an object of this invention to provide a method and means for slicing meat roasts that will enable the slicer to have more positive control over a hot, flabby, slippery piece of meat.

3. The problem of hand-slicing per se

When large numbers of servings are required at one time, for example at banquets, restaurants may use a slicing machine to slice a boneless rib. The machine is faster, and the uniformity of the slices more controllable than with hand slicing.

However, for normal every-day servings, most restaurants prefer to use hand slicing for three reasons:

a. The need to keep the meat hot.

For a dinner menu, ribs of beef must be hot. Continuous slicing while the meat is still hot is normally impossible because of the intermittent demand for this item. The chef may receive a half dozen orders for roast beef one minute, and then no more orders until 10 or 15 minutes later. In the meantime, the remaining (unsliced) portion of the rib must be placed back in the oven to be kept hot.

b. The need to reduce handling.

Unless the hot rib is continuously supported on a flat-surfaced movable base-board, which it is not with machine slicing, the physical handling and lifting by hand required to move the meat in and out of an oven and/or an oven pan, results in:

1. repeated squeezings of the meat as it is lifted, held and moved, which, in turn, produces
2. breakage of juice cells, leakage of valuable meat juices, and drier, less palatable meat.

The hot meat is much easier to handle, and much better for maintenance of quality, if placed on a slicing board that can be moved in and out of a hot oven, without being damaged by the oven's heat, and on and off a table, without actually handling, moving and/or lifting the meat itself by hand from its fixed position on such a hand-slicing board. But a simple slicing board, such as many restaurants now use, still leaves unresolved the basic problems involved in portion-controlling the weight uniformity of hand-sliced portions.

It is an object, therefore, to provide a hand-slicing board on which the meat can be kept hot while remaining in a fixed, flat, untouched position, while at the same time incorporating other features that will answer other basic slicing problems.

4. The problem of exact weights.

Restaurants purchase their meat by weight. Therefore, if they wish to maintain control over the cost of the meat they sell, they must also maintain control over the weights of the meat on their menu entrees. To do this, the weight of each slice that is served should be known and controlled. However, under the present state of the art this is a practical impossibility. The extreme non-uniformity of the rib's shape precludes the possibility of slicing portions of equal weight when the judgment of the human hand and eye in making a slice are the only determinants of what the weight of the finished slice will be.

This practical impossibility of producing slices of approximately equal weights from a boneless rib of beef is a source of constant and major irritation to a restaurateur. To prevent losing money, the restaurateur must price his slices considerably higher than would be necessary if his slicing was accurate. He must do this to compensate for inabilities of his kitchen personnel to slice accurate weights. Even the most experienced and skilled chef is unable to slice to accurate weights.

It is an object of this invention to provide a hand operated method and means which will produce (a) more accurate uniformity in the weights of slices cut from a boneless rib of beef, while at the same time (b) eliminate dependency on human hands and eyes to determine the uniformity in the thicknesses of such slices.

5. The problem of visible equality

In addition to controlling the weights of portioned slices, it is also desirable that there be a visible appearance of an equal quantity to each restaurant patron. A patron may feel cheated if he observes another patron receiving a larger and thicker appearing slice than he is being served. So, for appearance sake, there should be sufficient compensation between the surface area and the thicknesses of slices so it will appear that the actual quantities by weight served are indeed substantially equal.

It is an object of this invention to provide a manual method and means for slicing boneless ribs of beef that will increase the thickness, while the broad surface area decreases, of individual slices, as the meat is sliced from the broad end to the narrow end; so that the changes will represent a visible compensation in weight.

6. The problem of various thicknesses

To produce slices of uniform weights it is necessary to produce slices of various thicknesses. Because the conformation of the whole rib is so lacking in cross-sectional uniformity from end to end, and from side to side, changes in the thickness of slices must constantly be made in order to maintain equality in weight. Stated another way: to portion control the weight of each slice, adjustment must constantly be made in the thicknesses of the slices; to control weights per slice, compensation must be made in the thickness per slice. However, to control manually and visibly, and judge only with the hand and the eye, the constant changes in thickness necessary to produce a semblance of uniform weights in the slices is, for all practical purposes, an impossible task. Even the most skilled chefs cannot do it.

It is an object of this invention to provide a hand-operated method and means for slicing meat roasts to more uniform thicknesses without depending on the human hand and eye to judge thicknesses.

7. The problem of uniform thickness within each slice.

To produce uniform weights for each slice, it is obvious that each slice from the same area of the rib should be of uniform even thickness within itself. But this, too, is not easily accomplished with previous hand slicing. Even if a meat roast was perfectly uniform in shape, the human hands and eyes are not sufficiently reliable to produce an even thickness within every individual slice. A slight change in the angle of the knife from the perpendicular, and/or a slight deviation of the knife from being at a right angle to the length dimension of the rib, will produce a considerable change in the uniform thickness and weight of a slice. Even experienced, steady-handed, and steady-eyed chefs cannot cut a perfect uniformly thick slice every time.

Uniform even thickness within each slice is also desirable to avoid any feeling by the restaurant patron that he may be cheated in his particular serving of meat. If one end of a slice is thicker than the other end, he may feel that the thick end represents the thickness he is paying for, while the thin end is cheating him of his due.

It is another object to provide a manual method and means for producing uniform thickness within each slice.

8. The problem of keeping slices erect while slicing.

The desired portion-controlled weight of slices from a boneless beef roast will normally range from 4 oz. to 12 oz. per slice. The 12 oz. slice will normally range in thickness from ½ inch at the thickest end of the rib to 1 inch at the narrowest end of the rib. For a 4 oz. slice the thickness will range from about 3/16 inch to ⅜ inch. A boneless rib will range in thickness from about 3-½ inches at the narrow end to about 6-½ inches at the thick end. These dimensions represent the range in maximum widths of a slice of whatever thickness. Thus a slice which is ½ inch thick may have a width of 6-½ inches.

When a rib is being sliced, it will be lying with its length dimension horizontal to the board or table on which it is resting and its thickness dimension vertical to the resting surface. Therefore, a slice which is cut from a 6-½ inch thick section of a rib will be resting on a base of only ½ inch (the thickness of the slice) immediately after slicing.

When a roast is cold the juices are congealed and the meat is firm. It can be sliced without having the meat slices collapse under their own standing weights. But after roasting, the juices are fluid and the meat is flabby and its slices will collapse under their standing weights. For example, the slice at the thick (6-½ inch width) end of a roast immediately after it has been sliced may be relying on a narrow ½ inch base to hold erect a 6-½ inch height of 12 ounces of hot meat. Under the present state of the art, this slice would normally collapse and become twisted and distorted. In so doing, the distortions produced in the slice would act to squeeze out and lose valuable protein juices.

It is therefore an object of this invention to provide a manual method and means for holding a slice of hot roast meat erect in the same vertically-level plane in which it is sliced, and, thereby, prevent its collapse after it has been sliced.

9. The problem of transferring a finished slice from the situs of slicing to a serving plate.

After slicing, the hot flabby, slice must be transferred to a serving plate. Under the present state of the art, this is sometimes done with a large spatula; or a broad carving knife plus hand support under the areas not supported by the flat of the knife. But more often the meat is simply picked up by hand, with its accompanying finger-squeezing of the meat and consequent loss of some juices. In any event the meat is at least partially distorted and/or stretched so that some cell tissues are broken and protein juice is lost.

It is a further object to provide a manual method and means for transferring a hot slice of roast beef from slicing board to serving plate while the broad side of the slice is completely supported in the same flat, level, plane in which it was sliced, and maintain this plane at its broad side level from its original perpendicular position in and on the slicing board to the horizontal position on a serving plate.

10. The problems of sanitation a. Juice

Most restaurants today are inspected by local government officials for cleanliness and sanitation. A conscientious restaurant manager wants good cleanliness and sanitation even without government requirements.

Slicing of hot boneless ribs is a messy operation under the present state of the art. As the cook slices, the meat excretes juices which, if not contained, can quickly spread across a slicing table and onto the floor. After slicing, the table and/or other surfaces and apparatuses need careful and thorough washing and cleaning. Under the present state of the art, this can be an extensive chore if the juice has not been confined, by constant wiping, to the area immediately surrounding the meat. In any event, the valuable juice that has run onto and away from the slicing surface is lost.

It is an object to provide a method and means for confining and collecting the juice excreted during slicing so that it can be used in making gravy; and prevent it from spreading across relatively large areas that must be cleaned up; and/or into any difficult, and/or impossible-to-clean, areas of the slicing board.

b. Cleaning

To further assist in the problem of attaining an ideal state of sanitation, the preferred embodiment of my invention has as a further object, to provide a structure that is completely devoid of hinges, springs, crevices, butting joints, and/or any other parts that are hard to clean after disassembly.

11. The problem of curing all the problems

The need to provide a simple, easy to use, reliable hand-operated method and means to cure all ten of the preceding problems is ageless and unfilled by the prior art. Even more needful is a method and means to cure these problems in one single, simple, easy-to-use, reliable tool that will enable even an unskilled person in a restaurant kitchen to produce the desired results.

It is therefore, a principal objective of this invention to provide such a tool.

STATEMENT OF BASIC OBJECTIVES

At the heart of the first nine of the eleven preceding problems and objectives confronting the attempts of the prior art to portion-control the hand-slicing of boneless rib roasts is the complete dependency on the human hands and eyes. Under such dependency no real control exists in this industry.

For reasons mentioned above it is (a) a basic objective of this invention to retain the hand-slicing procedure for slicing meat roasts, but then (b) to eliminate the dependency on human hands and eyes to determine and guide both (1) the thickness per se, and (2) the uniformity of the thickness, and (3) thus the weight of every slice; and thus, in turn, (4) the uniformity of weights between all the numerous slices cut from the same rib.

Stated another way: it is a basic objective of this invention to retain the human hand as the motive power to perform such purely physical jobs as slicing, and making adjustments in the physical positioning of the meat on the board, but to eliminate the hand and the eye as controlling factors in determining the uniformity of the weights and the thicknesses of the slices.

DESCRIPTION OF THE DRAWINGS

The invention will be explained in conjunction with illustrative embodiments shown in the accompanying drawings, in which

FIG. 6 is a perspective view of the completely assembled slicing board with the knife positioned within the guide posts;

FIG. 7 is a fragmentary cross sectional view taken along the line 7—7 of FIG. 6;

FIG. 8 is a perspective view showing an operator in the act of slicing a boneless rib of beef on the slicing board;

FIG. 9 is a perspective view showing a completed slice laying flat on the index plate while the index plate is being pivoted from the vertical to a horizontal position;

FIG. 10 is a perspective view showing a hand sliding the flat-laying slice from the index plate onto a serving dish;

DESCRIPTION OF SPECIFIC EMBODIMENTS

In meeting the basic objectives, and overcoming the specific prior-art problems, I provide the following preferred embodiment of my invention having four (A, B, C, D) basic components, each specifically structured to function and cooperate with all the others:

A. The Base-Board

Figure 1:
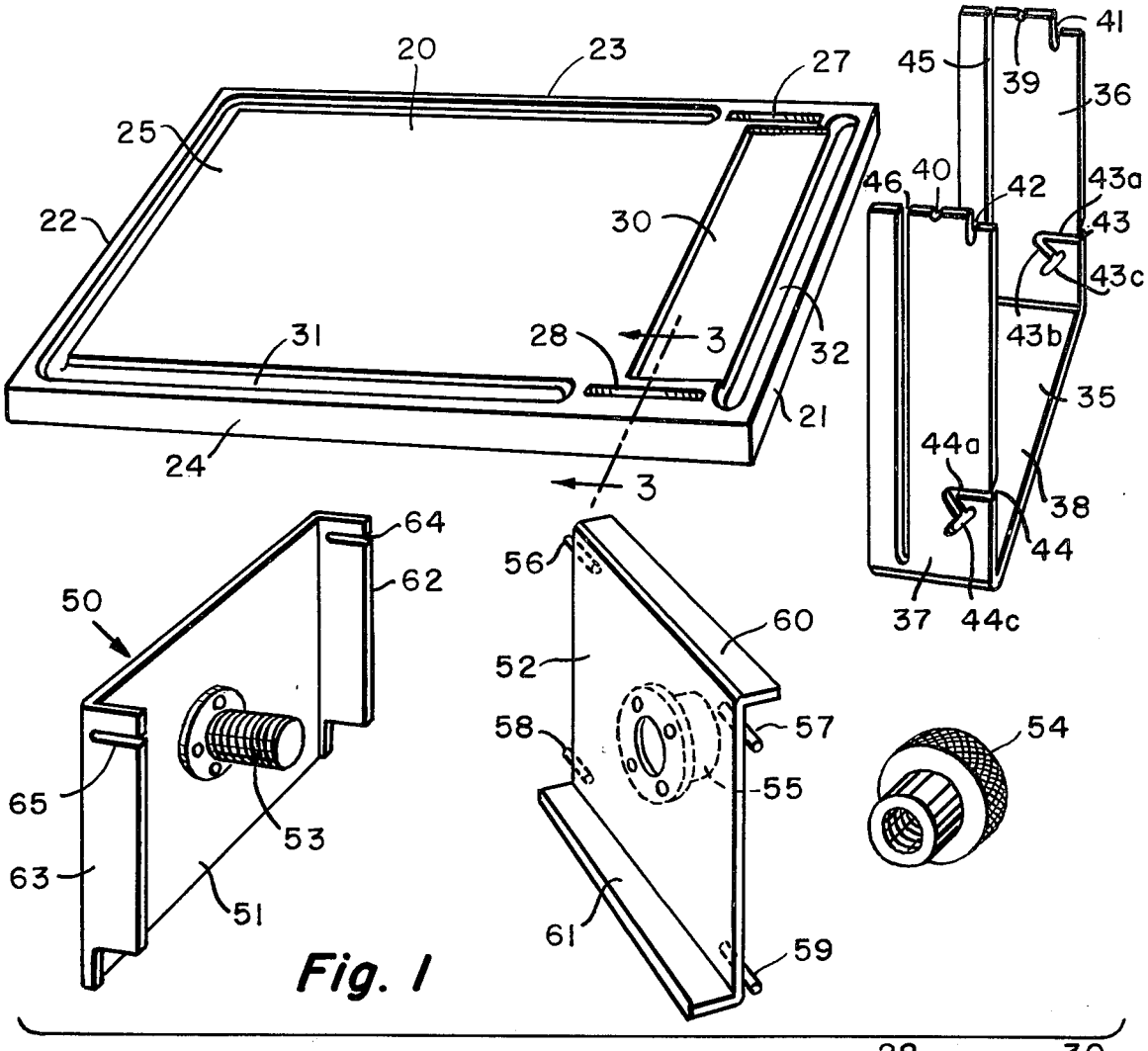
FIG. 1 illustrates the separate parts comprising the preferred embodiment of a slicing board formed in accordance with the invention.
Figure 2:
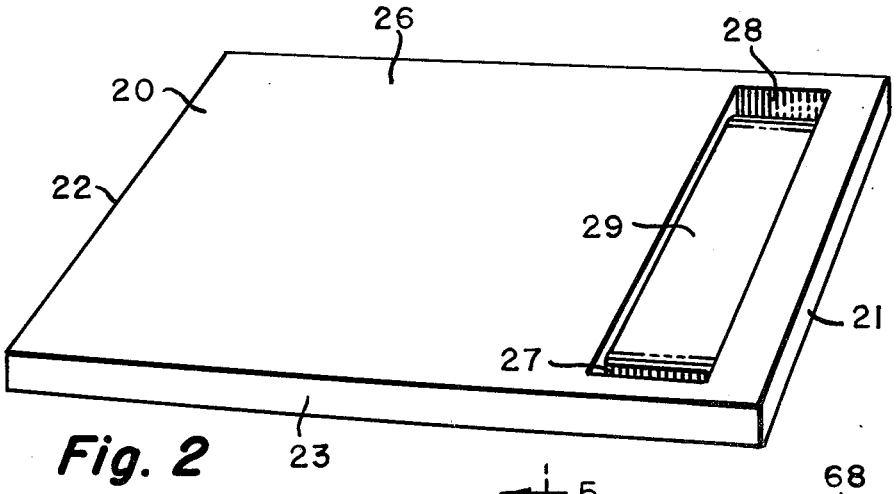
FIG. 2 is a perspective view of the bottom side of the base-board shown in FIG. 1.

The base-board 20 illustrated in FIGS. 1 and 2 is preferably made from a material which is FDA approved, non-moisture-absorbent, mold-resistant, non-abrasive to the cutting edge of a knife, and non-damageable by oven roasting heats. Materials such as wood or plastics such as high-density polyethylene or polypropylene are satisfactory. When plastic is used, it is advantageous to mold the board so that at least the upper surface has a pebble-grained skid-resistant surface.

Figure 3:
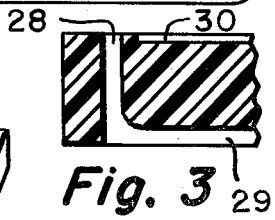
FIG. 3 is a fragmentary cross sectional view taken along the line 3—3 of FIG. 1.

The base-board is rectangular and has front, rear, and opposite side edges 21, 22, 23, and 24, respectively, and upper and lower surfaces 25 and 26. A pair of elongated slots 27 and 28 extend through the board just inwardly of the side edges 23 and 24, and the long dimensions of the slots extend parallel to the side edges. Referring to FIGS. 2 and 3, the slots open into a transversely extending rectangular recess 29 in the bottom surface of the baord, the width of the recess being the same as the length of the slots.

As will be explained more fully hereinafter, the slots 27 and 28 and recess 29 position and hold the knife guide posts, and the upper surface of the board is provided with a rectangular recess 30 (FIGS. 1 and 3) for holding the index plate. The recess extends transversely between the slots and terminates just inwardly of the slots.

A generally U-shaped juice-collecting trough 31 in the upper surface extends continuously adjacent the side edges 23 and 24 and the rear edge 22 and a separate trough 32 extends adjacent the front edge 21.

B. The Guide-Posts

The guide-posts 35 in FIG. 1 are a simple, one-piece, construction of flat, rigid, bar-stock type material, of metal, wood, or plastic. The material is bent, machined, or cast into a U shape having two upright posts 36 and 37 at both ends and a connecting member 38. This construction, with all inside corners, slots, and grooves open and accessible for easy cleaning, is designed to satisfy the most rigid requirements any sanitary code. The spacing between the posts is advantageously about 10 inches, which will accommodate the widest part of the widest commercially used beef rib.

The top of the posts are provided with oppositely aligned grooves 39 and 40 to indicate the beginning location for positioning the index plate for the knife to produce the proper thickness for the first slice from a boneless rib backed up against the index plate. The precise location of these aligned grooves is determined by the weight of the slices to be served. Since the first slice is cut from the largest end of the rib, it is always the thinnest slice. After that, to maintain approximately identical weights for each slice, the index plate is adjusted to increase the thickness of succeeding slices as the thickness of the rib narrows.

The top of the posts are provided with additional oppositely aligned slots 41 and 42 in, and on which one pair of hinge pins on the index plate fit and hang. At the bottom of the posts are oppositely aligned curved or V-shaped slots 43 and 44 into which another pair of hinge pins on the index plate fit. The slot 43 has a generally rearwardly extending horizontal entrant portion **43*a*, a downwardly and forwardly extending portion 43*b*, and a sliding portion 43*c* which extends perpendicularly to the portion 43*b*. The slot 44** is similarly formed.

A pair of oppositely aligned open straight slots 45 and 46 extend for substantially the entire length of the posts and function as guide-rails for the knife blade. The alignment of these slots is perfectly maintained to guarantee that the slicing knife always travels in a direction that is squared to the length and width of the meat, and thus, thereby guaranteeing that the meat is never sliced on a bias to either its length or width, and thus, in turn, assuring that the slices are always of substantially the same thicknesses on all of their edges. The width of these slots is about 1/64 inch wider than the maximum thickness of the knife blade. In functioning as guide-rails for the blade, they hold the blade in a fixed confined track, down which the blade travels in a precise vertical direction along a line of cut at right angles to the squared length and width of the meat roast, without dependence on, or direction from, the human hand or eye to produce accurate slices of an even and pre-determined thickness.

C. Adjustable Back-up or Index Plate Assembly

The numeral 50 in FIGS. 1 and 6 designates generally an adjustable back-up or index plate assembly. The plate assembly is shown disassembled in three parts in FIG. 1 and assembled in FIG. 6. It is called a back-up plate assembly because it provides a fixed back-board against which a meat roast can be backed-up and held in a stationary position while it is being sliced. It is also called an indexing plate assembly because it has an adjusting screw by which part of the assembly can be moved or indexed into measured increments of distance to provide changing and corresponding increments of thicknesses to produce uniform weights for the numerous slices taken from a meat roast, thus compensating for the irregular size and dimensions of the rib roast. This plate is actually an assembly of two plates, a back-up plate 51 and a support plate 52 which are adjustably connected to each other by a screw post 53 on the back-up plate and an internally threaded knob 54.

A bushing 55 is secured to the front surface of the support plate and is provided with a non-threaded bore through which the screw post can extend. A pair of upper support pins 56 and 57 and a pair of lower hinge pins 58 and 59 are secured to the front sruface of the support plate and extend laterally outwardly beyond the side edges thereof. An upper flange 60 extends forwardly from the top of the support plate, and a lower flange 61 extends rearwardly from the bottom of the support plate.

The back-up plate 51 includes a pair of vertical flanges 62 and 63 which extend forwardly from the sides of the plate, and the flanges are provided with slots 64 and 65 which are sized to receive the support pins 56 and 57. The screw post 53 is secured to the front surface of the back-up plate in approximately the center thereof.

The index plate assembly is assembled by inserting the screw post 53 through the bushing 55 and screwing the knob onto the protruding end of the screw. The side flanges 62 and 63 are spaced apart slightly greater than the width of the support plate, and the upper hinge pins 56 and 57 are recieved by the slots 64 and 65 (see FIGS. 6, 7 and 10). The lower edges of the side flanges terminate above the lower hinge pins 58 and 59 and need not be slotted to accommodate these pins.

The slicing board is assembled by inserting the guide posts 36 and 37 upwardly through the slots 27 and 28 from the bottom of the base board. The recess 29 in the bottom of the base board is sized to receive the connecting member 38 of the guide posts so that the base board can lie flush with a supporting surface. The depth of the recess is the same as the thickness of the connecting member so that when the base board is positioned in a horizontal position on a table or other supporting surface, the weight of the board will keep the posts firmly locked in an upright position. The long edges of the recess abut the edges of the connecting member to restrain the guide posts from rotating in a plane parallel to the plane of the board.

The index plate assembly is mounted on the guide posts by inserting the lower hinge pins 58 and 59 into the slots 43 and 44 of the guide posts until the pins are located in the inclined portions 43*c* and 44*c*, which prevent inadvertent removal of the pins. The support plate and back-up plate are maintained in a vertical position by the support pins 56 and 57 which are positioned in the slots 41 and 42 in the top of the guide posts. The recess 30 in the top surface of the board is sized to receive the bottom flange 61 of the support plate so that the upper surface of the flange will be flush with the upper surface of the board.

D. Slicing Knife

Figure 5:
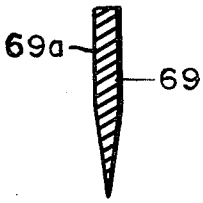
FIG. 5 is a cross sectional view of the knife blade taken along the line 5—5 of FIG. 4.
Figure 4:
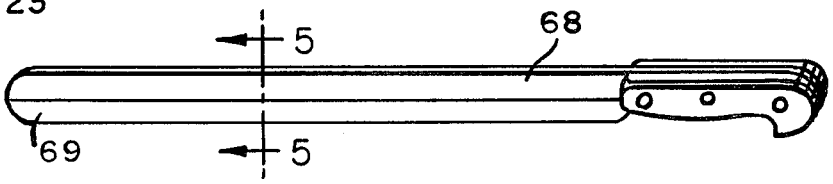
FIG. 4 is a perspective view of the specially designed knife for use with the slicing board.

A slicing knife 68 illustrated in FIG. 4 especially suitable for use with the slicing board. The knife has a blade 69 approximately 16 inches long; preferably at least 5 inches longer than the space between the guide-posts, so that the knife can move forward and backward in the guide slots 45 and 46 without being withdrawn as it slices the meat. The thickest part 69*a* (FIG. 5) of the blade is about 1/64 inch less than the width of the guideposts' slots. This thickest part of the blade is maintained at an even thickness thruout at least 50% of the blade's width, as shown in FIG. 5. The blade does not begin its taper to the cutting edge until about the middle of the blade's width. The purpose of the even non-tapered thickness thru the upper half of the blade is to maintain the blade's cutting edge, in a substantially perfect perpendicular position as it moves down thru the guide-rail slots and thru the meat. The function of this unusual thickness in the upper part of the blade is to prevent any sideways tipping of the blade as it travels down within the guide-rails; and thus prevent any slicing of the meat on a diagonal bias.

This precisely-guided knife movement effectively eliminates the deficiencies in the prior art that depended solely on the human hand and eye to guide the direction and movements of a slicing knife. In prior art practice a cutting knife is frequently off the vertical by 5% to 10%. Such variations from the strictly vertical can add to, or subtract from, 10% to 30% of the weight of a slice and leave one end of the slice two to three times thicker, or thinner, than its opposite end. Such variations, of course, render an effective portion-control hand-slicing system practically and totally impossible.

OPERATION

FIG. 7 shows a cross-section of my entire slicing board assembly and the relationship of all the several components to each other. It is this relationship, particularly centered in and around the index plate assembly, that is so critically important for the accomplishment of the objectives of this invention. For example, FIGS. 6 thru 10 illustrate clearly:

1. The positive fixed distance D between the knife blade 69 and the index plate 51 whenever slicing is in progress.

The knife cannot waver, weave, or tilt within the slotted guide-rail confines of the guide-posts. The index plate opposite the knife will not move from a positive, fixed position. It is held against lateral movement during slicing because its sides are held within the confines of the guide posts at points by the perpendicular side flanges 62 and 63 and at its bottom side by resting on the flange 61 of the stationary support plate 52, and it is held against any forward, backward, or angular movement by virtue of it being fixed to the stationary support plate by the threaded post 53 and knob 54.

With the distance D fixed, when an end of a meat roast R is positioned against the index plate and over and on top of flange 61 of the support plate, a perpendicular straight and even-thickness slice can be made without any direction from the human hand or eye, as illustrated in FIG. 8.

2. The flat level plane in which a completed slice is held regardless of the angle of plane in which it is held.

Hot beef rib slices are flabby and without a self-supporting body if stood on edge. When hand slicing such meat under the prior art, the operator holds the main body of the hot unsliced meat with one hand and operates the slicing knife with the other hand. As the operator cuts the meat, the sliced portion will fall away into a crumpled twisted heap. This twisting and crumpling breaks and fractures juice cells in the meat, and valuable meat juice leaks out and is lost. To the extent this happens, the slice is drier and less flavorful, and the meat is less appealing to a diner. To prevent this, we have provided the following cooperating structures, functions and operating sequences in the preferred embodiment of this invention:

First, after the meat is sliced, it is held in its immediate post-sliced condition in a perpendicular position on its narrow base-edge at a 90° angle to the surface of the base-board, with its broad sides held in a level plane between the unsliced portion of the meat and the index plate 51. In FIGS. 6 and 7 the index plate is held rigid when it is positioned within guide-posts 36 and 37 and support pins 56 and 57 are positioned within their respective guide-post slots 41 and 42. In this position, base flange 61 fits flush within base-board recess 30 and extends underneath and rearwardly of index plate 51. The front edge of the flange 61 terminates just forwardly of the knife guide slots 45 and 46. When the knife is raised and the unsliced meat is moved forward until it is against the index plate, the lower edge of the meat slides smoothly, without being bruised or torn, onto the extended flange 61. There it will rest after slicing and be held in a perpendicularly level plane between the index plate and the uncut portion of the meat. It is then ready to make its exit from its confinement between the unsliced meat and the index plate.

Secondly, when the index plate assembly is lifted up by grapsing it on flange 60 of support plate 52 and thus freeing support pins 57 and 58 from confinement in slots 41 and 42, while hinge pins 58 and 59 are still confined in tortuous slots 43 and 44, the slice is also lifted up by virtue of resting on flange 61 of the support plate. Then, as the support plate is pivoted downward as shown in FIG. 9, the meat slice's narrow base edge is held against flange 61 and its broad side is held flat on the index plate 51 as the index assembly pivots down to a horizontal position.

Thirdly, at the horizontal, FIG. 10, a hand movement can slide the flat, level-plane, meat onto a serving dish P, with the slice remaining in a free-lying, flat horizontal position.

Throughout all these changes the slice of meat always remains in the same flat, level-plane position it was in when first sliced from the roast. The orientation of the plane changes, but the flatness and levelness of the plane does not change. The entire mechanics of (a) cutting while a slice is held vertically erect, (b) lowering the finished slice to the horizontal plane while maintaining it against the flat plane of the indexing plate, and then (c) sliding it while still in a flat horizontal position onto a serving dish are specifically designed to maintain the protein juice cells of the meat in their original relaxed, undisturbed, undistorted, unpressed, condition, and thus prevent cell breakage and juice loss.

To accommodate the several movements and positions of hinge pins 58 and 59, the guide-post slots 43 and 44 are structured at angles and spaced distances clearly illustrated in the drawings. They are structured so that when (1) the index assembly is locked in upright position the pins locate at the bottom closed extremity of the angled portions 43*c* and 44*c* of the slots; when (2) it is moved upward to pivoting position, the pins are confined at the top closed extremity of the portions 43*c* and 44*c* of the slots; and when (3) it is moved for disengagement with the guide-posts, the pins can be moved upward and out through the open ends of the horizontal portions 43*a* and 44*a* of the slots.

The flat level-plane handling and mechanics, without pinching, twisting, bending, or distorting the sliced meat, has never been accomplished in the prioar art of hand-slicing meat roasts. Such handling is highly important to prevent the breakage of meat cells and the consequent leakage and loss of meat juices.

3. The changing thicknesses of slices necessary to maintain uniform portion-controlled weights of slices cut from boneless ribs of beef.

In FIGS. 6 and 7 the distance D between the knife and index plate 51 is adjustable by turning knob 54. This distance is adjustable in any degree and/or extent desired within the range allowed by the length of screw-post 53.

Since flange 61 of the support plate 52 extends underneath and forward from the bottom of the support plate, any change in distance between the knife and the index plate automatically provides the same dimension change in the distance which flange 61 extends ahead of the index plate and thus provides a base of substantially the exact thickness of every slice on which the slice can rest and be held as the index plate assembly swings down to the horizontal plane.

In addition to the preferred indexing means illustrated in the drawings, indexing may also be accomplished with several other means. Some of these are briefly described below. They all encompass means that come within the basic methods of this invention, and achieve in varying degrees the basic objectives:

a. An indexing plate of dimensions that fit within the guide-posts, having a flange extending outwardly from its bottom edge on the side opposite the meat; having stepped edges on this flange at graduated intervals; said stepped edges butting against pins set into the base-board at graduated positions corresponding to the stepped edges, whereby the indexing plate may be placed and held in graduated positions relative to the line of slicing. The position of the flange-steps against the pins may be changed to accommodate various desired thicknesses of meat.

b. An indexing plate fitted within the guide-posts having lateral extending pins or legs at its upmost corners which fit into spaced-apart indexing slots at the tops of the guide-posts into which the pins or legs may be inserted for a series of indexing positions; each slot providing a different distance between the plate and the line of cut.

c. A set of several indexing plates centered at right angles on bases each having different widths graduated from the others, whereby these different width bases may be inserted into corresponding width grooves cut into the base of the base-board between the vertical posts, so that each plate base, when positioned in its corresponding board-grooves, will provide a different distance between the plate and the line of cut.

d. An indexing plate comprising a single piece of rigid material bent at right-angles at its center to form two sides that function as two different back-up plates. When one side is standing vertical against the guide-posts, the other side serves as a right-angled base; and vice versa. Each side has steps that position its base against pins in the board that hold the plates at different distances between themselves and the line of cut.

e. An indexing plate which is fastened in vertical position to a gear-track resting on the base-board at the base of the plate, whereby the plate may be moved forward and backward to provide graduated distances between the plate and the line of cut.

Common to all of these indexing structures is the provision of an indexing facility that structurally guides a hand-operated slicing knife at a fixed pre-set distance between the knife and an indexing plate against which an uncut meat roast may be held and that is designed to eliminate dependency on the human hand and eye to produce slices of equal weights and even thicknesses.

The invention includes the following advantages:

1. A structure for the hand-slicing of meat roasts into slices of diner-sized portion-controlled weights without any dependence on human hands and eyes for guiding the cuts that produce such controlled weights.

2. Indexing back-up plates that can be moved and then fixed at spaced increments of distance between themselves and the cutting edge of a slicing knife.

3. A slicing knife that will cut down through an uncut meat roast in a guided movement that is perpendicular to the surface of a slicing base-board and at right angles to the horizontal length of the roast.

4. A slicing facility that will hold a slice, immediately after it has been sliced, erect in a perpendicular level plane between a back-up plate and the uncut portion of a meat roast.

5. A back-up plate in a meat-slicing structure that, while holding a meat slice on its level surface, can be moved from a vertical to a horizontal plane for a sliding horizontal-planed transfer of the meat slice to a serving dish.

While in the foregoing specification, a detailed description of a specific embodiment of our invention was set forth for the purpose of illustration, it will be understood that many of the details herein given may be varied considerably by those skilled in the art without departing from the spirit and scope of the invention.

We claim:

1. A slicing board for hand slicing boneless meat comprising a flat horizontally extending base-board, a pair of spaced-apart upright vertical posts secured to the base-board, each post having a vertically extending knife-guiding slot, a vertically extending index plate assembly removably mounted on the posts and extending therebetween, the index plate assembly maintaining a fixed distance between the index plate assembly and the knife-guiding slots during slicing, the index plate assembly including a horizontal flange at the base thereof upon which a completed slice of meat can rest its narrow edge while its broad sides are held in a vertical flat plane and hinge means for pivotally mounting the index plate assembly on the guide posts whereby the meat-holding index plate assembly may be pivoted from the vertical to a generally horizontal plane and whereby, with a simple sliding movement, the meat slice may be transferred, while still in a substantially flat horizontal plane, from the index plate assembly to a serving dish.

2. The structure of claim 1 in which the guide posts are provided by a rigid U-shaped member having two upright members forming the guide-posts and a connecting member extending between the upright members below the base-board, the base-board having a pair of slots through which the upright members are inserted and a recess in the bottom thereof which extends between the slots and receives the connecting member whereby the guide-posts are held secure and immovable while the base-board is resting bottom-side down on a supporting surface.

3. The structure of claim 1 in which the index plate assembly includes a vertically extending back-up plate against which the meat to be sliced can be positioned, a support plate adjacent the back-up plate, the hinge means being mounted on the support plate, and means adjustably securing the back-up plate to the support plate whereby the distance between the back-up plate and the knife-guiding slots can be adjusted as desired to vary the thickness of the meat to be sliced.

4. The structure of claim 3 in which the securing means for the back-up plate includes a screw mounted on the back-up plate and extending perpendicularly therefrom through the support plate, and nut means for drawing the screw through the support plate.

5. The structure of claim 1 in which the horizontal flange extends from the support plate below and beyond the back-up plate.

6. The structure of claim 1 in which the upper end of each guide post is provided with a recess, a pair of support pins on the index plate assembly removably received in the recesses for maintaining the index plate assembly fixed in a vertical position while the meat is being sliced, the index plate assembly being movable vertically upwardly to remove the support pins from the recesses and to permit the index plate assembly to pivot on the hinge means.

7. The structure of claim 1 in which the hinge means includes a pair of hinge pins extending laterally outwardly from opposite sides of the index plate assembly, each hinge pin being received in a slot in one of the guide posts, each of the slots having a first portion in which the hinge pins can rotate and move in a generally upward direction and a second portion through which the hinge pins can be withdrawn from the guide posts.

8. The structure of claim 1 including a knife having an elongated blade and a handle, a transverse cross section of the blade having an upper portion of uniform non-tapered thickness extending for about 50% of the length of the cross section and a lower tapered portion, the non-tapered portion having a thickness just slightly less than the thickness of the knife-guiding slots so that the blade is maintained by the slots in a perpendicular position relative to the base-board and the squared length and width of the meat as the blade slices through the meat.

9. The structure of claim 1 in which the base-board is provided with a recess which receives the horizontal flange of the index plate assembly so that the flange is flush with the base-board.

10. A hand operated slicing board for slicing hot boneless meat roasts comprising:

a. a flat base-board dimensioned to hold an odd-shaped meat roast, the base-board being made from a material that can be moved in and out of a hot oven without being damaged by meat-roasting oven heats, b. a pair of vertical posts extending upwardly from the base-board and spaced apart at a distance to accommodate the largest width of commercially sold meat roasts, each post having a vertically directioned, oppositely-aligned slot centered within the length of the posts to serve as a guide for directing and guiding the movement of a knife as it slices through the meat, c. an indexing plate assembly mounted on the posts and extending therebetween whereby the meat can be moved up against the indexing plate assembly and held there while being sliced, d. a pair of support pins extending laterally from the index plate assembly and removably received by recesses in the posts whereby said index plate assembly is held erect and immovable while the meat is sliced and whereby, in turn, the resulting slice is held erect and uncrumpled on, and between, the index plate assembly and the unsliced portion of the meat, and e. a right-angled extension flange at the base of the index plate assembly on which the base edge of a slice can rest in an erect position whereby an outward and downward movement of the index plate assembly at, and from, the base of the posts can swing said plate-held meat-sliced to a flat horizontal plane from which to slide the slice onto a serving dish without bending, squeezing, or otherwise distorting said slice, all designed to cooperate together for the purpose of producing meat roast slices of substantially equal portion-control weights and even thicknesses without depending on human hands and eyes for said purpose.

11. A method of hand slicing a boneless meat roast comprising the steps of:

a. placing the roast on a flat board, b. positioning it between two upright posts extending from the board, the posts having aligned vertically extending knife guide-rail slots, c. maintaining the posts rigidly in perfect alignment, thereby guaranteeing that slices cut from the meat are never cut on a bias to the length of the meat roast but always at a 90° angle to the length and thus, in turn, assuring that said slices are always of substantially equal thicknesses at their two opposite side edges, d. pressing and holding one end of the meat against a vertically standing stationary back-up plate adapted for indexing movements to produce the various thicknesses of meat slices required for portion-weight control slicing of the meat, e. spacing the plate at a distance from the slots equal to the desired thickness of a slice of meat, f. slicing said slice-thickness-spaced meat-end by moving a knife downwardly within the slots and through the meat while the slots are guiding the knife's line of cut at right angles to the squared length and width of the meat roast, thereby producing a slice that is of uniform pre-determined, even thickness without dependence on human hands or eyes, g. holding the completed slice flat and erect on a base-flange of the plate and between the uncut portion of the meat and the plate, h. pivoting the plate and the flange-held slice downwardly to a generally horizontal plane, and then i. transferring the slice with a sliding movement from the plate to a serving dish.

* * * * *